United States Patent [19]

Albrecht et al.

[11] Patent Number: 4,549,491

[45] Date of Patent: Oct. 29, 1985

[54] FEED DRIVE FOR A STITCH GROUP SEWING MACHINE

[75] Inventors: Ernst Albrecht, Hochspayer; Edgar Busch, Trippstadt, both of Fed. Rep. of Germany

[73] Assignee: Pfaff Industriemaschinen GmbH, Fed. Rep. of Germany

[21] Appl. No.: 615,461

[22] Filed: May 30, 1984

[30] Foreign Application Priority Data

Jun. 3, 1983 [DE] Fed. Rep. of Germany ..... 3320158

[51] Int. Cl.[4] ..... D05B 3/06

[52] U.S. Cl. ..... 112/73; 112/315; 112/453

[58] Field of Search ..... 112/65, 67, 73, 70, 112/70.1, 315, 316, 314, 158 E

[56] References Cited

U.S. PATENT DOCUMENTS

| | | | |
|---|---|---|---|
| 2,411,493 | 11/1946 | Wood | 112/73 |
| 3,426,709 | 2/1969 | Jindrich | 112/73 |
| 3,460,496 | 8/1969 | Meier | 112/73 X |
| 4,276,840 | 7/1981 | Takenoga et al. | 112/158 E X |
| 4,342,271 | 8/1982 | Socha | 112/315 X |
| 4,404,919 | 9/1983 | Martell et al. | 112/315 |

*Primary Examiner*—H. Hampton Hunter

*Attorney, Agent, or Firm*—McGlew and Tuttle

[57] ABSTRACT

A feed drive for a stitch group sewing machine includes a cam plate serving to drive a cloth clamp and it is connected with a separate motor. In order to keep the stitch length constant at varying length of the stitch group, the motor speed is controllable by a control device as a function of the rotational speed of the sewing machine, of the transmission ratio of a gearing between cam plate and cloth clamp which determines the length of the stitch group, and of the adjusted stitch length. The stitch group to be sewn can be divided into two sections with a stitch length variable independently of each other, in that a path-dependent switch operable after a partial revolution of the cam plate corresponding to the length of the first section alternately connects one of two potentiometers which determine the stitch length, with the motor control circuit.

4 Claims, 5 Drawing Figures q
VS
QS
ZZ
SP
$l_{ZZ}$
$l_{SP}$
$l_R$
42
41
37
88
86
89
90
95
100
103
102
X
A = W
$A = \frac{10B}{C}$
101
C
B1
B2
99
98
97
104
96
8
92
93
94
52
79
83

FEED DRIVE FOR A STITCH GROUP SEWING MACHINE

FIELD AND BACKGROUND OF THE INVENTION

This invention relates in general to sewing machines and in particular to a new and useful stitch group sewing machine which includes means for varying the stitch length of each stitch group.

A stitch group sewing machine wherein the length of the stitches in the group is controlled by gearing is shown in German Pat. No. 824,738 (U.S. Pat. No. 2,411,493). This known stitch group sewing machine is a buttonhole sewing machine with a work holder gripping the work in the region of the buttonhole to be formed. The work holder is driven by a first gearing controlled cam plate which makes one complete revolution during the formation of a buttonhole. A first cam slot moves the work holder parallel to the longitudinal axis of the sewing machine, and hence in lengthwise direction of the buttonhole to be formed. A second cam slot moves the work holder crosswise to the longitudinal axis of the sewing machine in connection with a second gearing. The needle bar is mounted in a pivotably mounted frame and executes swinging movements transverse to the longitudinal axis of the sewing machine for the formation of zig-zag stiches.

The first gearing contains an angle lever, whose one leg carries a sensor engaging in the cam slot and whose other leg comprises a link guide. In the link guide a sliding block of a pitman connected with the work holder engages in the link guide. By displacement of the sliding block in the link guide the transmission of the bearing and hence the amount of forward movement of the work holder parallel to the longitudinal axis of the sewing machine, can .be varied and in this way the length of the buttonhole to be formed can be adjusted.

The cam plate is intermittently set into rotation by a one way clutch which is in drive connection with the main shaft of the sewing machine via a drive mechanism. The transmission ratio of the drive mechanism can be adjusted similary as for the first gearing, whereby the speed of rotation of the cam plate can be varied at constant rotational speed of the main shaft. In this manner the number of stitches which form the buttonhole can be varied.

If when changing the buttonhole length the number of stitches is to be varied as well to obtain a constant stitch length, the transmission ratio of the drive mechanism must be matched very exactly to the transmission ratio of the first gearing. This mutual adaptation or adjustment is time consuming and requires a certain skill and experience, so that generally it must be effected by a mechanic rather than by the seamstress.

To eliminate the danger of follow-up or continued running that exists in the operation of a one way clutch due to inertia, the known sewing machine is provided with an intermittently active brake device acting at the circumference of the cam plate. Since such a brake is subject to wear, and since the braking depends on the surface quality or the degree of soiling of the friction surfaces so that no assurance for smooth operation of the cam plate is given especially at high speeds, such a drive system is not suitable for modern sewing machines, for which generally high speeds are required, to reduce the sewing time.

SUMMARY OF THE INVENTION

The invention provides a stitch group sewing machine wherein the ratio of speed of rotation of the cam plate to the speed of rotation of the sewing machine required for obtaining the desired number or length of stitches of the group to be sewn can be adjusted in a simple and yet exact manner and is maintained at the set value during sewing even at high rotational speeds of the sewing machine.

It is possible by electrical means and hence in an especially simple manner in terms of operation to adjust or vary the speed ratio between the sewing machine and the cam plate executing the forward movement of the work holder. Thus, while the length of the stitch group remains unchanged, the number of stitches and hence the basic adjustment of the stitch length can be set or changed. If, however, only the length of the stitch group is changed, then, as a function of the set transmission ratio of the gearing, the rotation speed of the motor for the cam plate and hence the number of stitches is automatically varied as well, so that the stitch length, one set, is preserved unchanged. Further it is possible to vary the length of the stitch group and the stitch length simultaneously, so that the basic data contained in a cam plate can be varied in many ways.

When using a sufficiently strong motor for the cam plate, where fluctuations of the load moment, caused e.g. by variations of the pitch angle of the control cam, do not bring about any appreciable variations of the motor speed, the ratio of cam plate speed to sewing machine speed required for obtaining a certain stitch group is maintained comparatively exactly during the entire sewing process.

The high accuracy is obtained in maintaining the required speed ratio by having an amplifier connected to the control device which is a variable gain amplifier arranged in a control circuit whose control variable is the rotational speed of the cam plate driving motor and whose command variable is formed by the control device.

A certain type of stitch group referred to as bar seam consists of one or more rows of straight, so-called tension stitches and a plurality of zig-zag stitches covering the tension stitches. The tension stitches have the purpose to give the bar seam a high tensile rigidity. This is best achieved with long stitch lengths. If however, the work holders is driven by the cam plate continuously rather than intermittently, the desire for great stitch lengths conflicts with the then occurring danger of needle breakage and damage to the work. Under these circumstances the tension stitches are advantageously formed with an average stitch length of 2.5 mm, and this for short as well as for long bar seams.

The possibility exists, at an unchanged length of the bar seam, to leave the number and hence the length of the tension stitches unchanged whereas the number and hence the length of the zig-zag stitches is varied, owing to which bar seams adapted to the particular purpose of use and type of cloth and having always an optimum tension stitch length of 2.5 mm and selectively narrow or wide zig-zag stitches can be formed. When changing the length of the bar seam, the number of tension stitches is varied as a function of the particular length of the bar seam by a corresponding variation of the speed of the cam plate, in such a way that also in this case, the optimum tension stitch length of 2.5 mm is maintained. With the invention it is possible to vary the basic data of a stitch group contained in a control cam plate relatively to each other also sectionwise, so that with a single cam plate a plurality of stitch group type modifications not previously attainable in the prior art can be achieved.

The control device advantageously comprises two potentiometers fed by the output voltage of a tachogenerator driven by the sewing machine. The output voltage of the potentiometers is alternately suppliable as a dividend by a switch which is actuable by the path dependent seitch to a dividing element. The control device comprises an additional potentiometer which is mechanically coupled with a displaceable element determining the transmission ratio of the gearing. It has an output voltage as a divisor which is supplied to the dividing element whose voltage forms forms the command variable of the control circuit.

Accordingly, it is an object of the invention to provide a stitch group sewing machine which includes a control device connected to the sewing machine into gearing which is variable for varying the swing and reciprocation of the needle so as to control the desired stitch length.

A further object of the invention is to provide a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
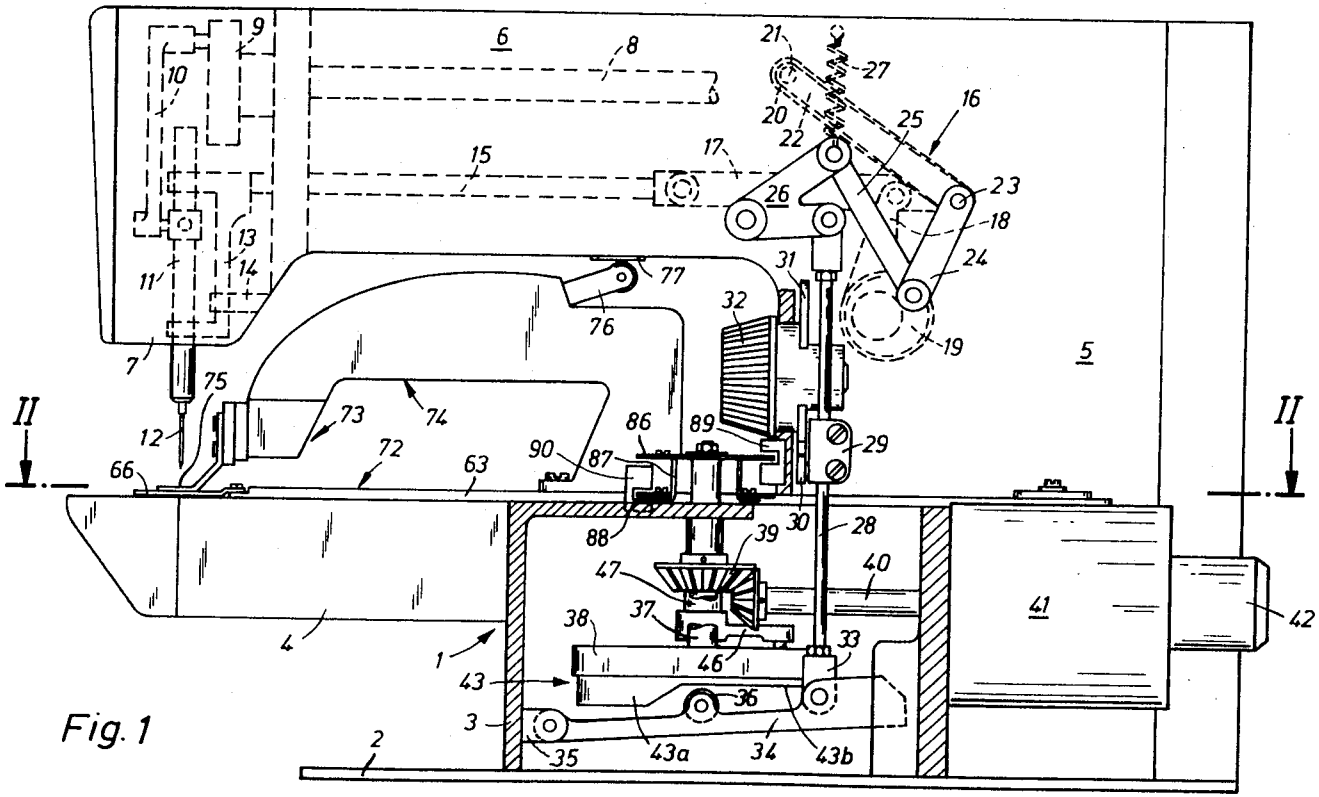
FIG. 1 shows a partial side elevational and sectional view of a stitch group sewing machine construction in accordance with the invention.

Referring to the drawings in particular the invention embodied therein comprises a stitch group sewing machine which comprises a housing generally designated 1 which contains a sewing machine drive including a drive arm shaft 8 which effects both the upward and downward movement of a needle 12 and the swinging of the needle in a swinging plane. A separate cam plate drive motor 41 drives a control cam plate 38 which drives a gearing generally designated 91 which has an adjustable transmission ratio and which drives stitch length control means at selective speeds. The cam plate is thus connected through a connecting mechanism for varying the desired stitch length of each stitch group.

The sewing machine comprises a housing 1 comprising a support plate 2, a pedestal 3, a supporting arm 4, a standard 5, and an arm 6 which terminates in a head 7. In arm 6 an arm shaft 8 is mounted which drives a needle bar 11 by way of a crank 9 and a pitman 10. In the needle bar 11 a thread carrying needle 12 is fastened, which cooperates with a shuttle or looper not shown for the formation of stitches.

The needle bar 11 is received in a frame 13 which is mounted for displacement on a bolt 14 running parallel to the longitudinal axis of arm 6 and is connected with a connecting rod 15 running parallel to it. Connecting rod 15 forms the output element of a zig-zag stitch setter 16 with which the overstitch width of zig-zag stitches is controlled. The zig-zag stitch setter 16 is a known hinged stitch setter. It comprises a lever 17, whose one end is connected with the connecting rod 15.

On lever 17 an eccentric rod 18 is articulated, which engages around an eccentric 19. Eccentric 19 is driven by the arm shaft 8 via a gearing (not shown). The other end of lever 17 is connected with one end of a pitman 20. At the other end of pitman 20, a crank 22 fastened on a shaft 23 and extending substantially parallel to pitman 20 engages via a bolt 21. Shaft 23 is passed through the wall of arm 6 and carries on the outer side of arm 6 a crank 24. Crank 24 is connected via a link 25 with one arm of a two-arm crank 26. At crank 26 there engages an extension spring 227 which exerts on crank 26 an upwardly directed tensile force. At the other arm of crank 26 a tie rod 28 is articulated.

On tie rod 28 a holder 29 is clamped, which carries, spaced to one side, a freely rotatable roller 30. Under the action of an extension spring 27, roller 30 takes support on the generated surface of a spiral cam plate 31. Cam plate 31 is secured on the hub of a handwheel 32 rotatably mounted on stand 5 and is adjustable in fine degrees in connection with a known lock means (not shown). The lower end of tie rod 28 is articulated via a hingepiece 33 to a split lever 34 which is mounted in a lug 35 of pedestal 3. In lever 34 a sensing roller 36 is mounted.

In pedestal 3 a vertically extending shaft 37 is mounted which carries at its lower end a cam plate 38. Shaft 37 is in drive connection with the output shaft 40 of a motor 41 via a bevel gearing 39. A tachogenerator 42 driven by shaft 40 is flanged to motor 41.

Cam plate 38 carries on the bottom side a concentic cam track 43 provided with axially offset sections **43*a*, 43*b*, which cam track is associated with the sensing roller 36 and thus controls the setting of the zig-zag stitch setter 16 within the limits established by the manually adjustable cam plate 31 as cam plate 38** revolves.

In its top side, cam plate 38 has a slot 44. In slot 44 engages a sensing pin 45 which is fastened to the free end of a lever 46. Lever 46 is fastened to the lower end of a shaft 47 mounted vertically in pedestal 3. At the upper end of shaft 47 a widened shoulder 48 is formed. By screws 49 a supporting arm 50 is fastened on shoulder 48, and on it a slide 51 of U-shaped cross-section is slidably arranged. On the underside of slide 51, two holding strips 52, 53 which partially engage the supporting arm 50 from below are fastened by screws 54. In a recess of slide 51 (not shown) cup springs also not shown, are arranged which press on the supporting arm 50 and bring about that slide 51 is secured by friction against automatic shifting. On the top side of slide 51 a flat cylindrical shoulder 55 is formed. On shoulder 55 a driver 56 is rotatably mounted which itself has a cylindrical projection 57 and a flat straight recess 58. Projection 57 is embraced by one flat end of a link 59 whose other end is connected with a setting lever 60. Setting lever 60 is passed through a cutout 61 in pedestal 3.

Driver 56 protrudes through a cutout 62 in the supporting arm 4. In recess 58 of driver 57 a flat, plate type arm 63 is received which rests on the top side of supporting arm 4. One end of arm 63 is rotatably arranged on a sliding block 64, which is displaceably mounted in a guideway 65 of pedestal 3 parallel to the longitudinal axis of supporting arm 4. The other end of arm 63 is connected with an exchangeable work carrying plate 66, which has a rectangular opening 67 for needle 12 corresponding to the maximum size of the bar seam to be produced. The slot type stitch hole in supporting arm 4 is marked 68. On the underside of arm 63, near the work carrying plate 66, a sliding block 69 is rotatably arranged. The sliding block 69 is displaceably received in a guiding groove 70 formed in an insert 71 disposed in the supporting arm 4. In its lengthwise direction the guiding groove 70 has a form such that it imposes on the pivoting motion of arm 63 a longitudinal displacement as arm 63 pivots about the axis of rotation of sliding block 64, so that arm 63 carries out in the region of the opening 67 a straight movement crosswise to the longitudinal axis of supporting arm 4.

Arm 63 and work carrying plate 66 form a lower clamping jaw 72 of a work holder 73 which holds the work in plier fashion. On arm 63 an upper clamping jaw 74 is fastened. Clamping jaw 74 contains a spring loaded holding plate 75 provided with a matching opening (not shown) for passage of needle 12. Holding plate 75 can be listed off the work carrying plate 66 in known manner through a roller lever 76 nd a vertically movable pressure plate 77.

The holding strip 52 fastened on slide 51 is formed as a rack which laterally projects over slide 51; it meshes with a pinion 79 arranged in a recess of shoulder 48. Pinion 79 is secured on a shaft 80 which is disposed in a centered bore 81 of shaft 47. At the lower end of shaft 80 is clamped the setting shaft 82 of a continuously adjustable potentiometer 83. The housing 84 of potentiometer 83 is fastened to lever 46 by a bracket 85.

An upper segmental disc 86 is secured at the upper end of the shaft 37 carrying cam plate 38, and on a U-shaped holder 87 a lower segmental disc 88. The upper segmental disc 86 cooperates with an inductive slot switch 89. The lower segmental disc 88 cooperates with a second inductive slot switch 90. On the part of pedestal 3 which projects laterally over supporting arm 4, a cap, (not shown) is arranged which rests against stand 5 and covers the slot switches 89,90 and the cam plate 38.

Lever 46 with the supporting arm 50 and slide 51, displaceable by lever 60 on supporting arm 50, form together with driver 56 a gearing 91 for the work holder 73.

Figures 4, 5:
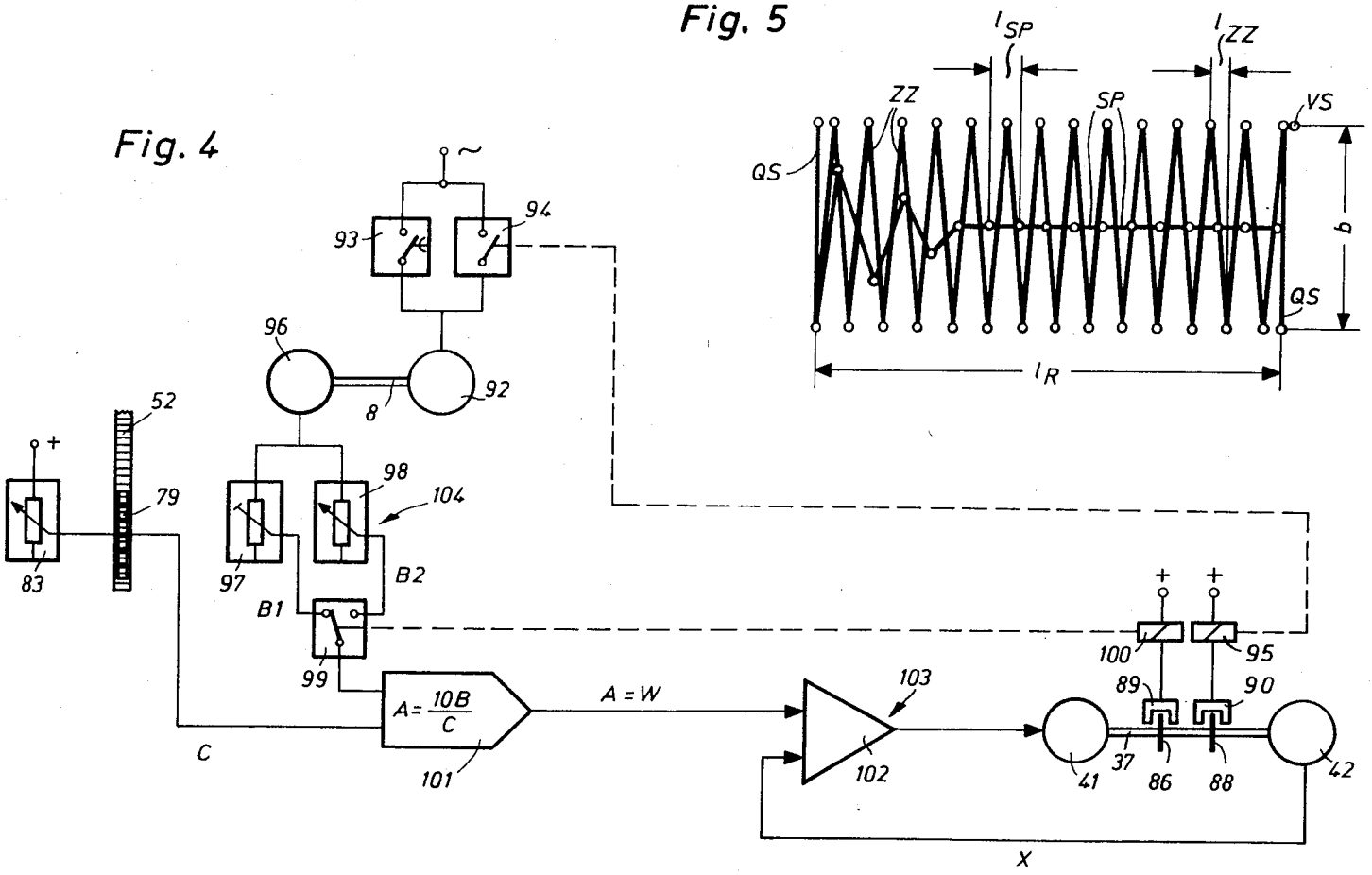
FIG. 4 is a block diagram of the regulating and control circuit of the motor for the control cam plate.
FIG. 5 is a plan view of a bar seam.

The sewing machine motor 92 shown symbolically in FIG. 4 is operated through a known control circuit (not shown). Associated with the control circuit is a switch 93 with delayed automatic cutoff for turning motor 92 on, as well as a switching contact 94 of a relay 95. Switch 93 and contact 94 are in parallel. Motor 92 drives the arm shaft 8 of the sewing machine through a belt drive (not shown).

On arm shaft 8 a tachogenerator 96 is secured. The output voltage of tachogenerator 96 is supplied simultaneously to two manually adjustable potentiometers 97, 98 of which one 97 serves to set the stitch length $l_{SP}$ of tension stitches SP and the other 98 to set the stitch length $l_{ZZ}$ of zig-zag stitches ZZ. The output voltage B1,B2 of the two potentiometers 97,98 is supplied via a two-position contact 99 of a relay 100 alternately to a first input of a dividing element 101 as a dividend. Potentiometer 83, coupled mechanically with gearing 91, serves to set the bar length $l_R$. The output voltage C of potentiometer 83 is supplied as divisor to a second input of the dividing element 101.

The dividing element 101 is a four-quadrant analog multiplier ICL 8013 of Intersil with the function $$A = \frac{10\,B}{C}$$

operated as a division circuit. The factor 10 results from the internal construction of the dividing element 101.

The output voltage A of dividing element 101 is supplied as command variable W to a variable gain amplifier 102, which operates in four quadrants and therefore is able to deliver current for both directions of rotation of the connected motor 41, but also drain current in both polarities for braking motor 41. The variable gain amplifier 102 is the clocked power amplifier BN 6441 of the firm ESR. Variable gain amplifier 102 contains a comparator circuit for the comparison between the command variable W representing the instantaneous desired value and the controlled variable X representing the instantaneous actual value. The variable gain amplifier 102 further contains a power stage for the direct operation of motor 41, which is a permanently energized d-c motor. The tachogenerator 42 connected with motor 41 reproduces the speed $n_K$ of this motor as d-c voltage in analogous manner. The output voltage of tachogenerator 42 is supplied to the variable gain amplifier 102 as controlled variable X representing the actual value.

Variable gain amplifier 102, motor 41, and tachogenerator 42 jointly form a control circuit 103. Tachogenerator 96, the potentiometers 83, 97, 98 and the dividing element 101 form together a control device portion 104 for the formation of the command variable W for the control circuit 103.

The slot switch 89 acting as path dependent switch is connected with the relay 100, which upon release of slot switch 89 switches the make-and-break contact 99 in such a way that the potentiometer 97 which serves to set the tension stitch length $l_{SP}$ is connected with the dividing element 101. The slot switch 90 which also acts as path dependent switch is connected with relay 95, which upon release of the slot switch 90 switches contact 94 to open position, thus interrupting the circuit of the sewing machine motor 92.

The stitch group sewing machine operates as follows: The mode of operation of the sewing machine will be explained with reference to the formation of a type of stitch group referred to as bar seam. The bar seam illustrated in FIG. 5 comprises a series of straight tension stitches SP, which toward the end of the bar seam gradually change over to zig-zag stitches. The stitch length of the tension stitches SP is designated $l_{SP}$. At the end of the tension stitch seam lie one or more stitches designated as transverse stitches QS of zero stitch length. Then follows a number of zig-zag stitches ZZ of stitch length $l_{ZZ}$, covering the tension stitch seam. At the end of the zig-zag seam are again one or more transverse stitches QS and one or more finishing stitches VS, which are formed at the site of the last transverse stitch QS.

The bar seam illustrated in FIG. 5 comprises a total of 48 stitches and has a bar length $l_R$ of 40 mm. The 48 stitches are grouped in 16 tension stitches SP, 4 transverse stitches QS, 1 finishing stitch VS and 27 zig-zag stitches ZZ. The tension stitches SP have a stitch length $l_{SP}=40/16$ mm$=2.5$ mm, and the zig-zag stitches ZZ a stitch length $l_{ZZ}=40/27$ mm$=1.48$ mm.

For the formation of the bar seam according to FIG. 5, the cam plate 38 rotates at constant speed during the entire sewing process, that is both in the tension stitch and in the zig-zag region. For the formation of the tension stitches SP an angle of $$\frac{360 \times 16}{48} = 120°$$

of the cam slot 44 is available. The transverse stitches QS, the zig-zag stitches ZZ, and the finishing stitch VS are distributed over the remaining 240°. In the tension stitch region the cam slot 44 has per stitch a greater radial rise than in the zig-zag region. The radial cam rise $\Delta r_{SP}$ in the tension stitch region is 1.285 mm, the radial cam rise $\Delta r_{ZZ}$ in the zig-zag region, 0.74 mm.

For the formation of the tension stitches SP the speed $n_K$ of the motor 41 which drives the cam plate 38 must be in a certain ratio to the speed $n_A$ of the arm shaft 8, to the bar length $l_R$, and to the stitch length $l_{SP}$. These various factors are in the following functon relations: $n_K$ approx.

$$\frac{l_{SP} \times n_A}{l_R}.$$

Figure 2:
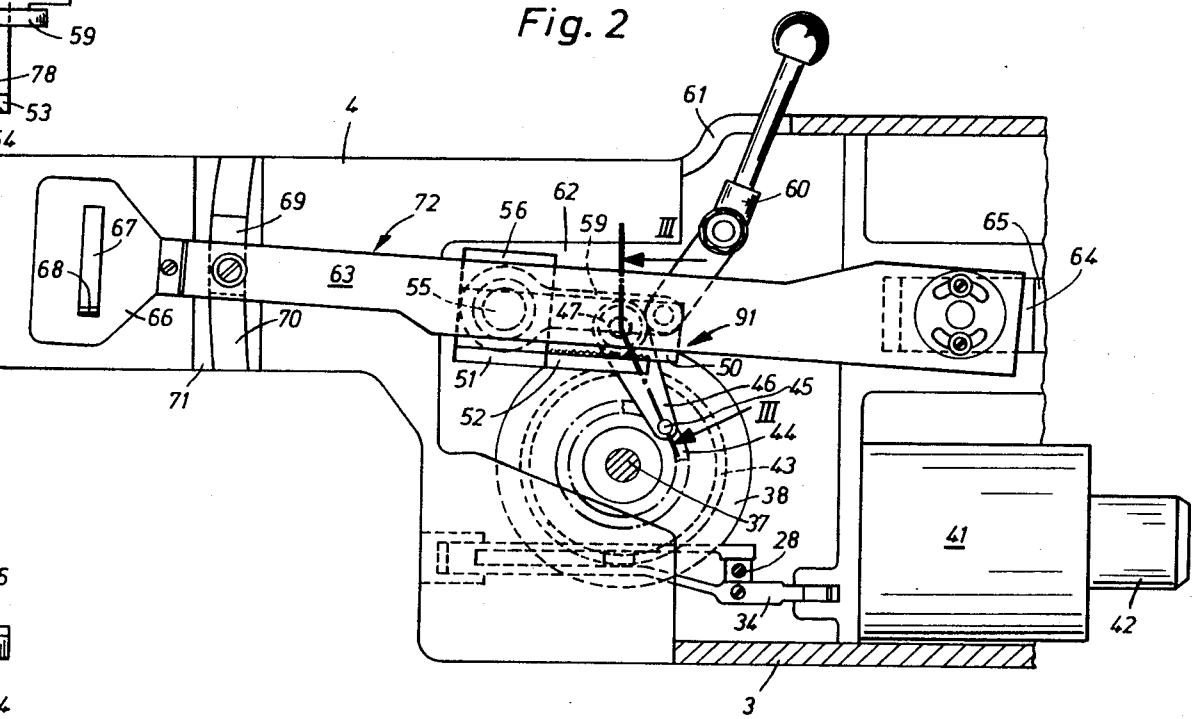
FIG. 2 is a sectional view along line II—II of FIG. 1.
Figure 3:
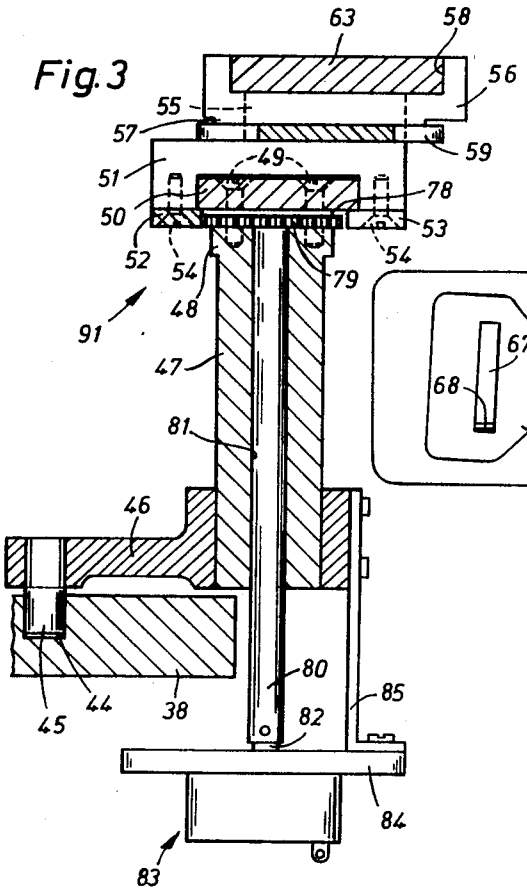
FIG. 3 is a sectional view along line III—III of FIG. 2.

For the formation of the bar seam according to FIG. 5, the slide 51 on supporting arm 50 is shifted to the left according to FIG. 2, through the setting lever 60, upo to the limit of the setting range. In this position of slide 51 the driver 56 has the maximum possible distance from the axis of rotation of shaft 47, so that at gearing 91 the maximum transmission ratio is set. Upon displacement of slide 51, the holding strip 52 connected therewith and formed as a rack rotates the pinion 79 and adjusts the potentiometer 83 via shaft 80 to a value analagous to the transmission ratio of gearing 91. The potentiometer 97 for setting the stitch length $l_{SP}$ is always set to the stitch length 2.5 mm. The potentiometer 98 for setting the stitch length $l_{ZZ}$ is set to the value of the desired stitch length $l_{ZZ}$, that is, for the bar seam according to FIG. 5, to 1.48 mm.

The sewing machine is switched on by actuating switch 93, whereupon motor 92 drives the arm shaft 8 during the first stitches at a speed of 1000 min$^{-1}$. With the switching on, voltage is applied to potentiometer 83 and to amplifier 102. The output voltage C of potentiometer 83, which is dependent on the transmission ratio of gearing 91 and hence reproduces the bar length $l_R$ in analogous form, is continuously applied to the dividing element 101. The speed $n_A$ of the arm shaft 8 is reproduced by the tachogenerator 96 as dc voltage in analogous manner. The output voltage of tachogenerator 96 is supplied simultaneously to the two potentiometers 97, 98. As motor 92 is being turned on, the segmental disc 86 is outside the slot switch 89. In this position of the slot switch 89 the relay 100 is switched so that contact 99 connects the potentiometer 97 for adjustment of the switch length $l_{SP}$ with the dividing element 101 and the output voltage B1 thereof is connected to the dividing element 101. The voltages B1 and C are divided in the divison element 101 according to the formula $$A = \frac{10\,B}{C},$$

B1 being the mathematical product of the analogous voltage values for the input variables $l_{SP}$ and $n_A$, and C analagous voltage value for the input variable $l_R$.

The output voltage A of the dividing element 101 is supplied as command variable W of the control circuit 103 to the amplifier 102. The output voltage or amplifier 102 is supplied as armature voltage to motor 41, the speed $n_K$ of motor 41 being proportional to the magnitude of the applied voltage. When sewing the bar seam according to FIG. 5, at a speed $n_A$ of the arm shaft 8 of 1000 min$^{-1}$ there results for the motor 41 driving the cam plate 38 a speed $n_K$ of 17.8 min$^{-1}$.

The tachogenerator 42 in drive connection with motor 41 reproduces the speed $n_K$ of motor 41 representing the controlled variable X in analogous manner as d-c voltage. For a variance comparison, the output voltage is tachogenerator 42 is supplied to one input of the variable gain amplifiier 102, whereby the desired speed value given by the command variable W is maintained very exactly.

After a few stitches the speed $n_A$ of the sewing machine is increased to 4000 min$^{-1}$. The output voltage of tachogenerator 96 thus increasing proportionally immediately brings about a corresponding increase of the output voltage B1 of potentiometer 97 and hence of the output voltage A of the dividing element 101 or respectively of the command variable W. The increase of the command variable W leads directly to a corresponding increase of the speed $n_K$ of motor 41 to a value of 71 min$^{-1}$.

At the time the sewing machine is switched on, the segmental disc 88 is outside the slot switch 90. Owing to this, relay 95 is switched so that contact 94 is open. After a short time motor 41 has rotated shaft 37 so that the segmental disc 88 enters into the slot switch 90, and as a result relay 95 is switched and contact 94 is closed. It is only then that switch 93, which operates with delayed automatic switch-off, opens, so that from that time on motor 92 is connected with its control circuit via the closed switching contact 94.

During the sewing of the tension stitches SP, the seady drive of cam plate 38 and the continuous motion of cam slot 44 bring about a steady pivoting of lever 46. The pivoting movement of lever 46 is transmitted via supporting arm 50 and via slide 51 adjusted thereon and via driver 56. Driver 56 pivots arm 63 about the axis of rotation on sliding block 64.

The transmission ratio of gearing 91 determined by the position of slide 51 and the speed $n_K$ of motor 41 controlled as a function of the transmission ratio as well as of the speed $n_A$ and of the adjusted tension stitch length $l_{SP}$ bring about that the work holder 73 is pivoted by an amount of 2.5 mm in the region of the opening 67 during each stitch formation so that correspondingly long tension stitches SP result. The continuous pivoting of the work holder 73 does indeed lead to a deflection of the needle 12 inserted in the work, but at a stitch length of 2.5 mm the deflection is still so small that neither needle breakage nor impairment of the thread linkage nor a visible impairment of the work occur.

During the sewing of the tension stitches SP, lever 34 is pushed down by the lower section 43a of the cam track 43 far enough for the tie rod 28 to hold the pitman 20 of the zig-zag stitch setter 16 is a substantially horizontal position parallel to lever 17. In this position of pitman 20 the vibratory movements created by eccentric 19 at lever 17 have no influence on the positon of the connecting rod 15, so that frame 13 and needle bar 11 execute no lateral movements.

Toward the end of the tension stitch region, the section 43*b* of cam track 43 gets into the zone of the sensing roller 36. By the action of extension spring 27 the sensing roller 36 is pulled upward, with crank 24 pivoting pitman 20 with bolt 21 upward via crank 26, link 25, crank 24, and the crank 22 rigidly connected with it. As lever 17 is connected with the end of pitman 20 opposite bolt 21, the swinging motion created by eccentric 19 at lever 17 causes at the same time a swinging motion of pitman 20. Due to the displacement of bolt 21, the swinging motion of pitman 20 now has at the hinge point with lever 17 a horizontal component, which brings about that lever 17 and hence connecting rod 15 and the needle bar 11 execute lateral swinging movements in the rhythm of the stitch formation. These will, toward the end of the tension stitch region, create a gradual transition from the straight tension stitches SP to the transverse stitches QS, which have the same overstitch width b as the following zig-zag stitches ZZ.

The overstitch width b is determined by the set position of cam plate 31. Cam plate 31 limits the upward movement of tie rod 28 caused by spring 27 in that it serves as a stop for roller 30.

After the control cam plate 38 has run through the angle of 120° provided for the formation of the tension stitches SP, the segmental disc 86 enters into the slot switch 89 and switches relay 100, whereby contact 99 is switched and potentiometer 98 for setting the stitch length $l_{ZZ}$ of the zig-zag stitches ZZ is connected with the dividing element 101. Now the speed $n_K$ of motor 41 is approx.

$$\frac{l_{ZZ} \times n_A}{l_R}.$$

Since for the formation of the bar seam according to FIG. 5 the ratio of stitch length $l_{SP}$ to stitch length $l_{ZZ}$ corresponds to the ratio of the radial rise $\Delta r_{SP}$ of cam slot 44 to the radial rise $\Delta r_{ZZ}$ and therefore the speed of motor 41 in the region of the zig-zag stitches ZZ is the same as in the region of the tension stitches SP, the output voltage B2 of potentiometer 98 has in this case the same value as the output voltage B1 of potentiometer 97, so that the command variable W remains unchanged.

Toward the end of the sewing process, the control circuit of motor 92 reduces the speed $n_A$ of arm shaft 8 from 4000 $min^{-1}$ to 1000 $min^{-1}$. Immediately thereafter, the speed $n_K$ of motor 41 is reduced in the same ratio via the control device 104 and the control circuit 103.

After one complete revolution of control cam plate 38, the finishing stitch VS is formed and the bar seam is completed. At this moment the two segmental discs 86 and 88 move out of the slot switches 89, 90, whereby through the two relays 95 and 100, for one thing contact 94 is opened and hence motor 92 turned off and, for another, contact 99 is switched again and thereby potentiometer 97 is connected with the dividing element 101. Motor 92 is braked almost instantly from the reduced speed to zero, owing to which also the output voltage of the tachogenerator 96 is reduced to zero just as quickly. As a result, the command variable W becomes zero almost without delay and with equal rapidity motor 41 is braked, so that no appreciable follow-up motion of cam plate 38 takes place.

If, starting with the bar seam according to FIG. 5, the bar length $l_R$ is to be shortened, then, via lever 60, the transmission ratio of gearing 91 is reduced while at the same time the potentiometer 83 is adjusted to a value proportional thereto. Since now the reduced output voltage C is supplied to the dividing element 101 as divisor, the output voltage A and the command variable W increase. As a result, motor 41 is now operated at a higher speed $n_K$. At a bar length $l_R$=25 mm, the speed $n_K$ increased both for the tension stitch and for the zig-zag stitch range at a speed $n_A$ from 1000 $min^{-1}$ to 28.5 $min^{-1}$ and at a speed $n_A$ from 4000 $min^{-1}$ to 114 $min^{-1}$. In connection with the smaller transmission ratio of gearing 91, the higher speed $n_K$ again results in a stitch length $l_{SP}$ of 2.5 mm in the tension stitch region and a stitch length $l_{ZZ}$ of 1.48 mm in the zig-zag stitch region. Now, however, the bar seam consists of fewer stitches.

If at constant stitch length $l_{SP}$ of 2.5 mm the stitch length $l_{ZZ}$ in the zig-zag stitch region is to be reduced for example to 0.6 mm, the desired stitch length $l_{ZZ}$ is set on the potentiometer 98. Since the output voltage B2, now reduced in value, is supplied to the dividing element 101 as dividend, during sewing in the zig-zag region the value of the output voltage A and of the command variable W diminshes. The result is that, after contact 99 has been switched, motor 41 is now operated in the zig-zag stitch region at a lower speed $n_K$ as compared with the speed $n_K$ in the tension stitch region. While at a bar length $l_R$ of 40 mm and a speed $n_A$ of 1000 min−1 the speed $n_K$ in the tension stitch region is again 17.8 $min^{-1}$, in the zig-zag stitch region the speed $n_K$ diminishes to 9 $min^{-1}$. At a speed $n_A$ of 4000 $min^{-1}$ there results for the tension stitch region a speed $n_K$=71 min −1 and for the zig-zag stitch region $n_K$=36 $min^{-1}$. The diminished speed $n_K$ in the zig-zag stitch region therefore shortens the stitch length $l_{ZZ}$ and brings about that the number of zig-zag stitches is correspondingly greater than in the bar seam according to FIG. 5.

While specific embodiments of the invention have been shown and described in detail to illustrate the application of the principles of the invention, it will be understood that the invention may be embodied otherwise without departing from such principles.

What is claimed is:

1. A stitch group sewing machine comprising a housing, a sewing needle mounted in said housing for upward and downward movement and for lateral swinging movement in a swinging plane, a sewing machine main drive including a rotatable arm shaft connected to said needle for moving said needle in upward and downward and swinging motion, a work holder mounted on said housing for swinging movement across the swinging plane of said needle, a cam plate rotatable in said housing connected to said work holder for controlling the swinging movement of said work holder, a separate cam plate drive motor in said housing connected to said cam plate for rotating said cam plate, a gearing having an adjustable transmission and connected between said work holder and said cam plate, and a control device connected to said sewing machine cam plate drive motor and said sewing machine main drive and said gearing for varying a resultant stitch length which is formed by said sewing machine.

2. A stitch group sewing machine according to claim 1, wherein said control device includes an amplifier in the form of a variable gain amplifier, said control device including a control circuit with said amplifier producing a controlled variable which is the rotational speed of said cam plate drive motor and producing a command variable.

3. A stitch group sewing machine according to claim 2, wherein for subdividing the stitch group into at least two sections of stitch length variable independently of each other, said control device comprises a path dependent switch which can be actuated after a partial revolution of said cam plate corresponding to the length of said first section 4. A stitch group sewing machine according to claim 3, wherein said control device includes two potentiometers, a tachogenerator having an output connected to said two potentiometers and being driven by said sewing machine, a first switch connected to said potentiometers for delivering a respective output voltage thereof as a dividend, a path dependent switch connected to said first switch for actuating said first switch, a dividing element connected to said first switch, said control device comprising an additional potentiometer, a displaceable element mechanically coupled to said additional potentiometer and determining the transmission ratio of said gearing and said additional potentiometer having an output voltage forming a divisor supplied to the dividing element whose output voltage forms the command variable of said control circuit.

* * * * *